US006018915A

United States Patent [19]

Pomish et al.

[11] Patent Number: 6,018,915

[45] Date of Patent: Feb. 1, 2000

[54] SLIDING AND LOCKING WALL PANELS

[75] Inventors: Bob Pomish, W. Bloomfield; Terry Neff, Ray, both of Mich.

[73] Assignee: PCI Industries, Inc., Oak Park, Mich.

[21] Appl. No.: 09/314,252

[22] Filed: May 18, 1999

Related U.S. Application Data

[60] Provisional application No. 60/117,952, Jan. 29, 1999.

[51] Int. Cl.[7] ..... E04B 1/346

[52] U.S. Cl. ..... 52/64; 49/449; 49/503

[58] Field of Search ..... 52/64; 49/449, 49/503

[56] References Cited

U.S. PATENT DOCUMENTS

| | | | |
|---|---|---|---|
| 1,934,299 | 11/1933 | Fairhurst | 49/127 |
| 2,966,706 | 1/1961 | Christensen | 49/277 |
| 3,295,257 | 1/1967 | Douglass | 49/317 |
| 3,309,816 | 3/1967 | Malone, Jr. | 49/127 |
| 3,479,769 | 11/1969 | Diack | 49/449 |
| 3,594,031 | 7/1971 | Ford | 292/140 |
| 3,685,223 | 8/1972 | Sherwood | 52/64 |
| 3,693,293 | 9/1972 | Edgan, Jr. et al. | 49/56 |
| 4,267,666 | 5/1981 | Davidson | 49/449 X |
| 4,277,920 | 7/1981 | Dixon | 52/64 |
| 4,475,313 | 10/1984 | Governale | 49/449 X |
| 4,872,286 | 10/1989 | Peirish et al. | 49/449 |
| 4,872,287 | 10/1989 | Block | 49/449 |
| 4,944,169 | 7/1990 | Labelle et al. | 70/100 |
| 5,125,202 | 6/1992 | Kissinger | 52/64 X |
| 5,356,185 | 10/1994 | Cameron | 49/449 X |
| 5,471,791 | 12/1995 | Keller | 52/64 X |
| 5,577,348 | 11/1996 | Keller | 52/64 X |
| 5,755,060 | 5/1998 | Zweili | 49/449 |

FOREIGN PATENT DOCUMENTS

| | | | |
|---|---|---|---|
| 722344 | 11/1965 | Canada | 52/64 |

*Primary Examiner*—Beth Aubrey
*Assistant Examiner*—Brian E. Glessner
*Attorney, Agent, or Firm*—Kohn & Associates

[57] ABSTRACT

A wall panel assembly includes a track upon which a wall panel can travel for guiding movement of the wall panel, at least one moveable panel entrained on the track for movement thereon between a privacy position wherein information is hidden by or hidden on the moveable panel and a non-privacy position wherein the information is exposed and a locking mechanism for locking the moveable wall panel in either of the positions.

6 Claims, 4 Drawing Sheets

SLIDING AND LOCKING WALL PANELS

CROSS-REFERENCE TO RELATED APPLICATIONS

This is a conversion of Provisional Application No. 60,117,952 filed Jan. 29, 1999, which is incorporated herein by reference.

BACKGROUND OF THE INVENTION

1. Field of the Invention

The present invention relates to sliding and locking wall panels.

2. Description of Related Art

Often in office settings, the wall space in a conference/meeting room is minimal. This is especially true in offices which utilize cubicle space and only have one area allotted for a conference room. This creates a problem because a number of different groups are using the same conference room. Items which need to remain confidential cannot be left on display when one group leaves the conference room, or a manager must lock the conference room, thus making the conference room unavailable for other groups. This creates additional work for individuals to maintain confidentiality.

Previously, portable wall panels were utilized thus enabling individuals to take the wall panels with them. However, this does not eliminate the problem; it instead changes it because additional work is still involved in the transport of these wall panels. In U.S. Pat. No. 2,966,706 to Christensen, there is disclosed a lock for slidably mounted closures. However, such closures are not utilized for panels which are mounted on a wall. However, neither of these attempted solutions overcome the problem associated with maintaining confidentiality and privacy on a slidable wall panel.

Others have tried to remedy this problem by making lightweight panels which are removable and can thus be removed from the conference room to maintain confidentiality. Another attempt to correct this problem was to develop sliding panels which move over one another. However, these do not really overcome the initial problem of the desire of confidentiality without having to constantly remove and replace items.

It would therefore be useful to develop a wall panel that allows for confidential material to be left in a conference room without the possibility of losing the confidentiality.

SUMMARY OF THE INVENTION

According to the present invention, there is provided a wall panel assembly having a track upon which a wall panel can travel for guiding movement of the wall panel, at least one moveable panel entrained on the track means for movement thereon between a privacy position wherein information is hidden by or hidden on the moveable panel and a non-privacy position wherein the information is exposed and a locking mechanism for locking the moveable wall panel in either of the positions.

DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
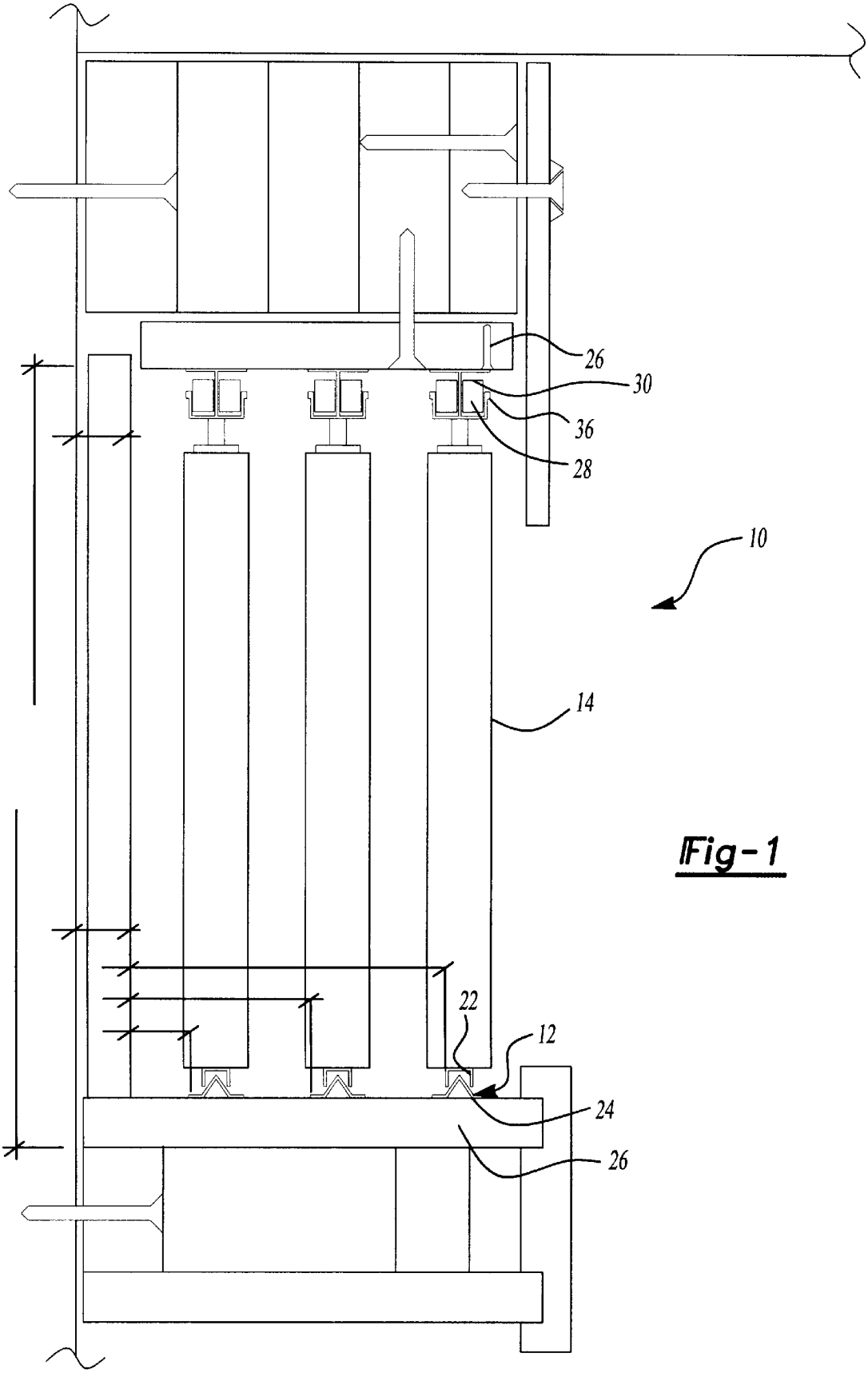
FIG. 1 is a side view of the present invention wherein the rollers are attached to the top portion of the wall panel.
Figure 2A:
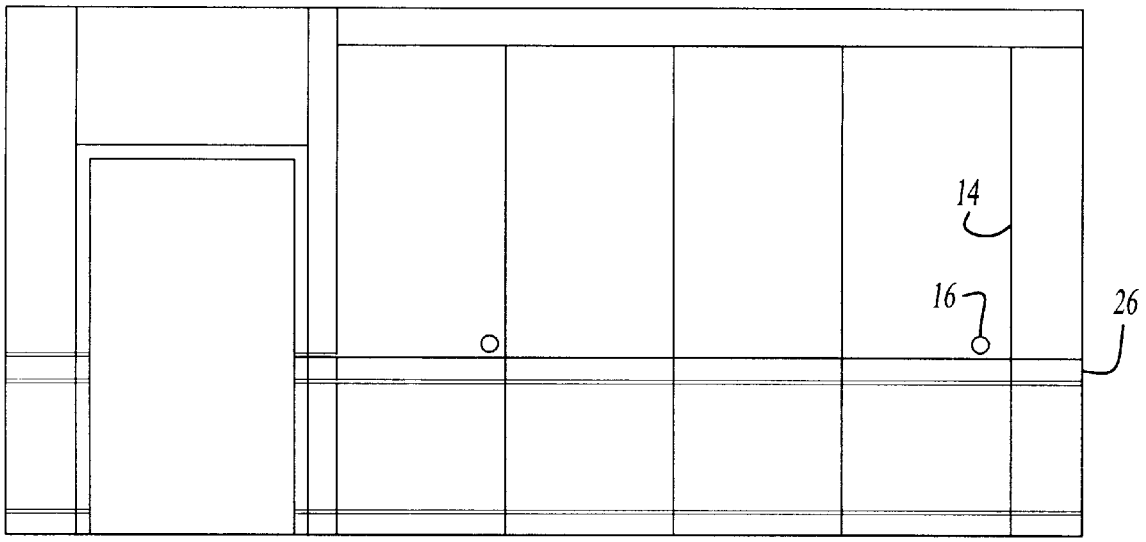
FIG. 2A is a front view of the sliding wall panels.
Figure 2B:
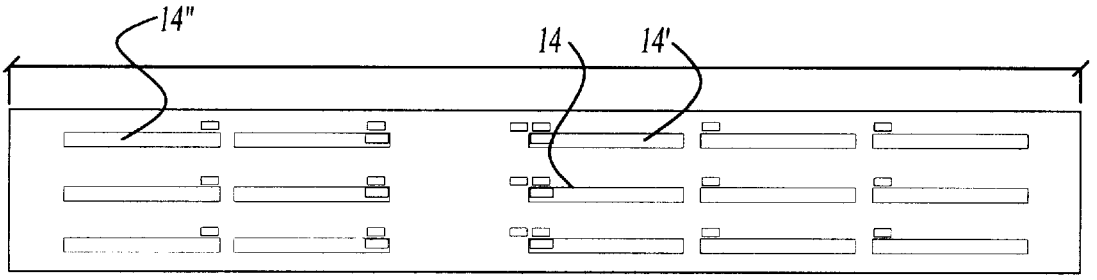
FIG. 2B is a top view of the present invention.
Figure 3:
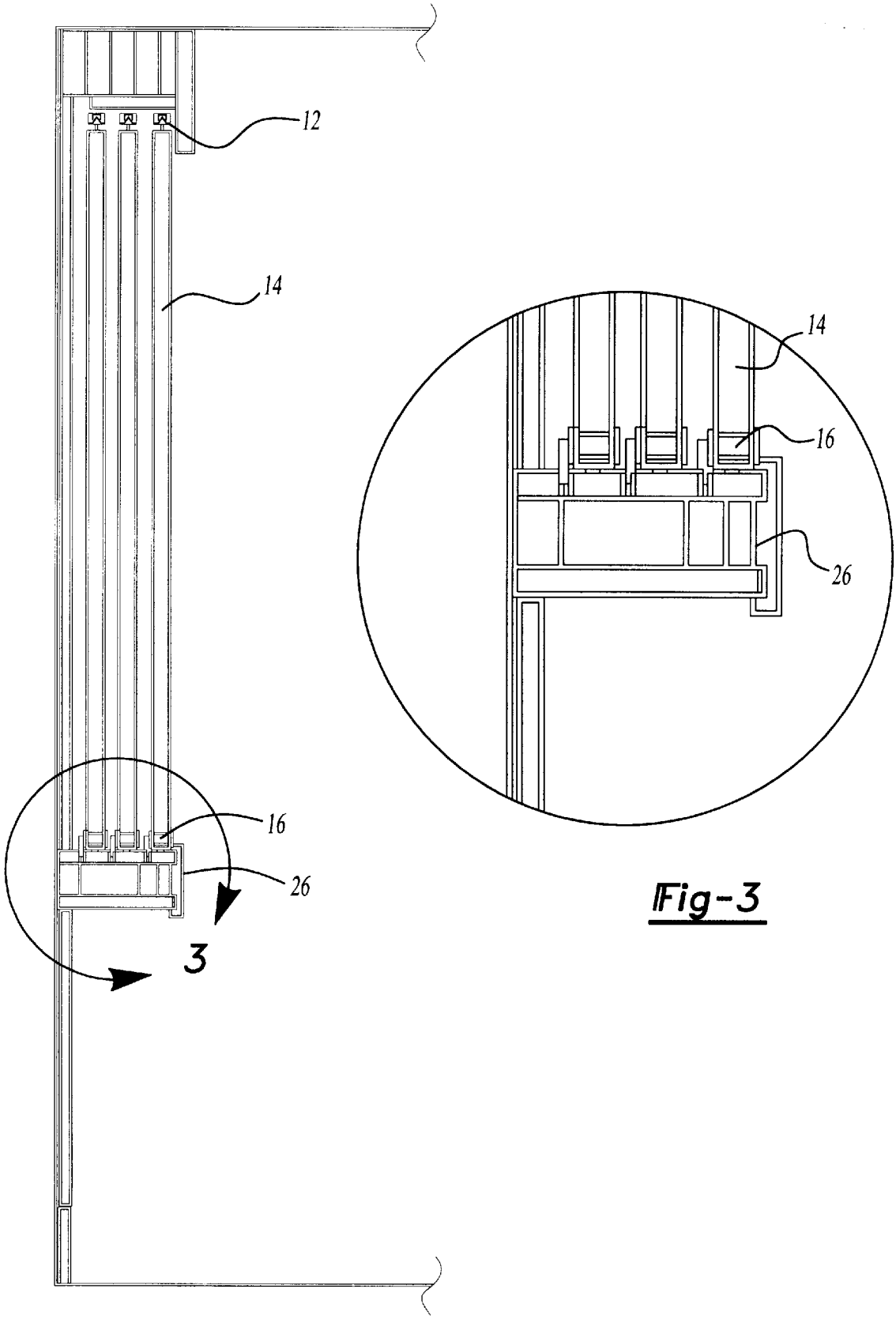
FIG. 3 is an enlarged view of the lock mechanism on the base of the slidable wall panel.
Figure 4:
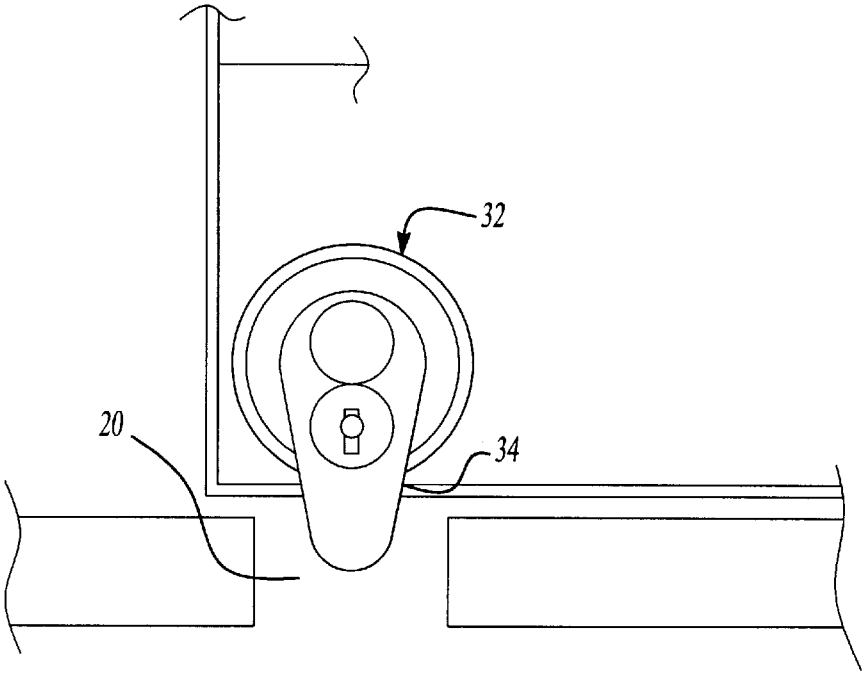
FIG. 4 is an enlarged view of one embodiment of the present invention wherein the lock is a cam lock.
Figure 5:
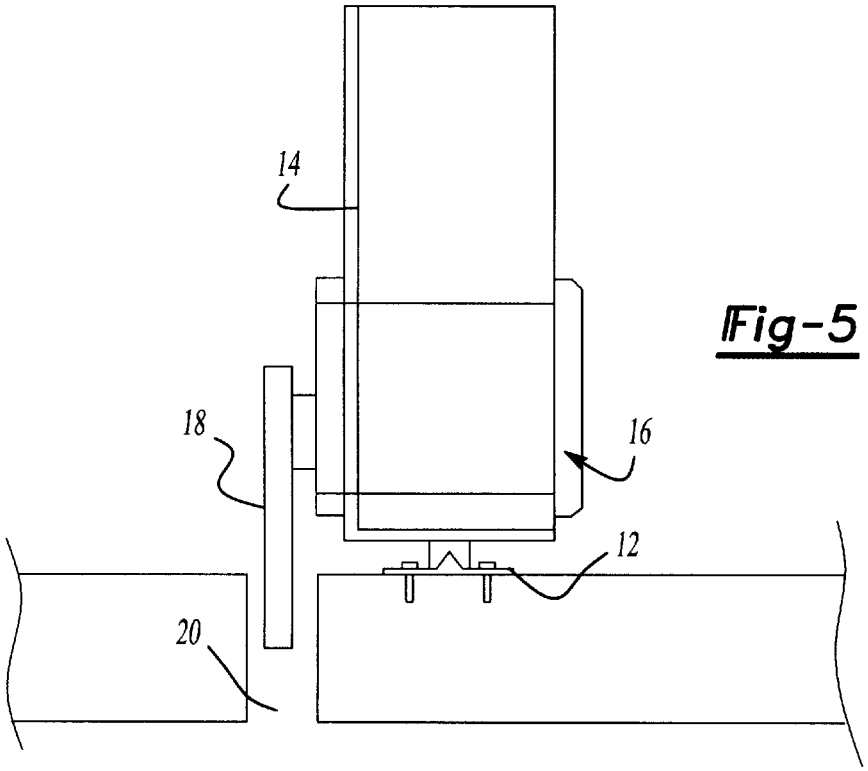
FIG. 5 is an enlarged side view of the cam lock embodiment.

Generally, the present invention relates to a wall panel assembly 10 including a track 36 or 12 upon which a moveable wall panel 14 can travel for guiding the movement of the wall panel 14, at least one moveable wall panel 14 entrained on the track 36 for movement thereon between a privacy position wherein information is hidden by or hidden on the moveable panel 14 and a non-privacy position wherein the information is exposed. A locking mechanism 16 locks the moveable panel 14 in either of the above positions.

More specifically, the locking mechanism 16 is made up of a locking member 18 and a locking receptor 20. Preferably, the locking member 18 is located on the moveable panel 14, and the locking receptor 20 is located within the track 36 or 12. However, the positions may be reversed. The locking mechanism 16 allows for locking engagement of the locking member 18 within the lock receptor 20 effectively locking the moveable wall panel 14 into the track 36 or 12 in a fixed position. These fixed positions may be in either a privacy or non-privacy position.

The privacy position allows for confidentiality of the material which is affixed onto the wall panel 14 and the non-privacy position does not create such a confidential relationship as described in greater detail with regard to the different embodiments below.

In preferred embodiment of the present invention, the locking mechanism 16 is located on the bottom portion of the wall panel 14 thus allowing the moveable wall panel 14 to easily be moved and locked into place. While this is the preferred location for the locking mechanism 16, the locking mechanism 16 may be placed on any portion of the wall panel 14 which allows for the locking member 18 to become in mating engagement with the lock receptor 20. This enables the moveable wall panel 14 to be effectively locked into place in the track 36 or 12 in the privacy position.

Additionally, the locking mechanism 16 can be any form of lock which allows for a locking member 18 and a locking receptor 20 to be utilized, thus enabling an individual to lock a moveable wall panel 14 into place in any one of the privacy or non-privacy positions. Examples of the locking mechanism 16 include a cam lock 32, deadbolt lock or any other lock which is commonly known by those skilled in the art which has both a locking member 18 and a lock receptor 20.

The track 12 preferably is attached to an upper rail member and also includes bearing numbers 28, which are preferably rollers, located on the moveable wall panel 14, which ride on and are guided by the rail member 30. This upper rail member is preferably supported by a platform 26 which includes locking receptors 20.

The track 12 can also be attached to a lower rail member 24 and also includes bearing members 22, located on the moveable wall panel 14, which ride on and are guided by the rail member 24. This lower rail member 24 is preferably supported by a platform 26 which includes locking receptors 20. In one embodiment of the track mechanism 12, rollers 28 and a tracking mechanism 30 for receiving the rollers are utilized. The rollers 28 may either be attached to the moveable wall panel or be attached to the platform 26. The track mechanism 30 itself is attached to the opposite member. If the rollers 28 are fixedly attached to the wall panel 14, the track mechanism 30 is fixedly attached to the platform 26. Conversely, if the rollers 28 are fixedly attached to a platform 26, then the track mechanism 30 is fixedly attached to the wall panel 14. These rollers 28 allow for the wall panel 14 to be slidably moved along the track mechanism 30 thus enabling positioning of the wall panel 14 in relation to other wall panels 14 in either a privacy or non-privacy position.

While the track mechanism 30 and roller 28 system is preferred, other mechanisms as are known to those skilled in the art which also allow the slideable movement of the wall panel 14 in relation to other wall panels 14 may also be utilized.

In another embodiment of the present invention, there is combined the locking mechanism 16 and the track 36 or 12. There is attained a moveable wall panel 14 having a locking mechanism 16 which includes a cam lock 32 which is mounted on the moveable wall panel 14 wherein the cam lock 32 includes a cam member 34 having a locked position. The cam member 34 thus engages one of the lock receptors 20 present on the platform 26 to place the wall panel 14 in a locked privacy or non-privacy position. Additionally, by disengaging the cam lock 32 from a locked position, the wall panel 14 is free to slideably move along the track 12.

The wall panels are made of a surface having tackable or velcroable qualities or a dry erase marker board or other board enabling one to write directly on the surface. Additionally, any other surface material may be utilized enabling one to affix material to the surface of the moveable wall panel.

Another embodiment of the present invention provides a wall panel assembly which includes a plurality of moveable wall panels 14 entrained in parallel horizontally on a track 36 or 12. This allows multiple wall panels 14 to be combined in a single wall panel assembly 10. The wall panels 14 are configured in such a way to enable moveable wall panels 14 to be locked in front of other moveable panels 14, thus defining the privacy position. Therefore, one wall panel 14 can be placed in front of a second wall panel 14 and locked in place for enabling privacy or confidentiality of the material which is located on the first wall panel 14.

In another embodiment of the present invention, a fixed wall panel 15 is mounted in parallel with the track 36 or 12 such that the moveable wall panel 14 can be locked behind the fixed wall panel 15 in order to define a privacy position. Therefore, privacy is ensured by sliding the moveable wall panel 15 behind a fixed wall panel 14 thus ensuring complete confidentiality of any materials affixed to the moveable wall panel 14.

In another embodiment of the present invention, the moveable wall panels 14 are slid vertically, as opposed to horizontally, up and down a surface. While, in the preferred embodiment, the wall panels 14 are slid horizontally along a track 36 or 12 which is parallel to the floor or ceiling in this additional embodiment, the track 36 or 12 is perpendicular to the wall or ceiling, thus allowing an individual to utilize an entire height of a wall and still function as a locking wall assembly 10 for privacy standards. In order to ease movement of the moveable wall panels 14 in this embodiment, the track 36 or 12 will utilize a counter-weight mechanism thus enabling a slight bit of movement to move the entire moveable wall panel 14.

Additionally, the wall panel assembly 10 can include a plurality of moveable wall panels 14 entrained in parallel on the track 36 or 12, thus allowing multiple wall panels 14 to be utilized in a single wall panel assembly 10. The wall panels 14 are configured in such a way to enable moveable wall panels 14 to be locked in front of other moveable panels 14, thus defining the privacy position. Therefore, one wall panel 14 can be placed in front of a second wall panel 14 and locked in place for enabling privacy or confidentiality of the material which is located on the first wall panel 14.

In each of the embodiments, privacy is obtained by a moveable panel concealing information posted behind it, on either a fixed or moveable panel, or a moveable panel having information on it is moved to and locked behind another panel. Unlike prior art assemblies, the present invention provides a wall system which functions as an information mount which also provides means for concealing the mounted information if desired by the wall system. Multiple moveable walls with independent locks allow for multiple users while keeping all mounted information in confidence.

Throughout this application, various publications, including United States patents, are referenced by author and year and patents by number. Full citations for the publications are listed below. The disclosures of these publications and patents in their entireties are hereby incorporated by reference into this application in order to more fully describe the state of the art to which this invention pertains.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

What is claimed is:

1. A wall panel assembly comprising:

a wall having a length and a depth made up of sets of moveable information panels; wherein each set comprises a plurality of moveable information panels, said sets are spaced apart from one another throughout the depth of the wall;

a plurality of parallel track means upon which said sets of moveable information panels can travel for guiding movement of said moveable information panels;

said moveable information panels being entrained on said track means for movement thereon parallel to other of said moveable information panels in said set of moveable information panels between a privacy position wherein information is hidden by or hidden on said moveable information panels and a non-privacy position wherein the information is exposed, said sets of moveable information panels forming a continuous portion of a wall in length and depth when in said non-privacy position and being disposed within said wall or behind another of said moveable information panels when in said privacy position; and locking means for locking said moveable information panels in either of said positions.

2. A wall panel assembly as set forth in claim 1 wherein each of said locking means includes a locking member on said moveable information panels and said track means includes lock receptors for locking engagement with said locking member in each of said positions to effectively lock each of said moveable information panels independently to said track means in either of said positions.

3. A wall panel assembly according to claim 2 wherein said track means includes a lower rail member, said moveable information panels including bearing members riding in and being guided by said rail member, said rail member supported on a platform, said platform including said lock receptors.

4. A wall panel assembly according to claim 3 wherein said locking member includes a cam lock mounted on said moveable information panels, said cam lock including a cam member having a locked position wherein said cam member engages one of said lock receptors in said platform and a unlocked position wherein said cam member is disengaged from any of said lock receptors.

5. A wall panel assembly according to claim 1, wherein said plurality of said moveable information panels are entrained in parallel on said track means wherein one of said moveable information panels can be locked in front of another of said moveable information panels to define one of said privacy positions.

6. A wall panel assembly according to claim 1, wherein said series of moveable information panels mix with the thickness of the wall.

* * * * *